US005348505A

United States Patent [19]

Rothhammer

[11] Patent Number: 5,348,505

[45] Date of Patent: Sep. 20, 1994

[54] SWIMMING AID DEVICE

[76] Inventor: Reed Rothhammer, 2635 Edgeview La., Arroyo Grande, Calif. 93420

[21] Appl. No.: 33,459

[22] Filed: Mar. 19, 1993

Related U.S. Application Data

[63] Continuation of Ser. No. 822,206, Jan. 16, 1992, abandoned.

[51] Int. Cl.[5] ..... B63C 9/08

[52] U.S. Cl. ..... 441/117; 441/119

[58] Field of Search ..... 441/106, 108, 113–115, 441/117, 119, 129, 80, 88; 2/67

[56] References Cited

U.S. PATENT DOCUMENTS

| | | | |
|---|---|---|---|
| 1,164,180 | 12/1915 | Garrison | 441/117 |
| 1,446,099 | 2/1923 | Marks . | |
| 1,511,006 | 10/1924 | Prescott | 441/117 |
| 3,077,618 | 2/1963 | O'Link | 441/113 |
| 3,138,889 | 6/1964 | Bergens | 441/113 |
| 4,123,814 | 11/1978 | Ettinger | 441/113 |

*Primary Examiner*—Robert J. Oberleitner
*Assistant Examiner*—Clifford T. Bartz
*Attorney, Agent, or Firm*—Willian Brinks Hofer Gilson & Lione

[57] ABSTRACT

A water exercise device to be worn by a person who is desirous of acquiring increased buoyancy while exercising in water. The device includes a waist-encircling band of flexible buoyant material such as elastomeric foam through which is intertwined a flexible and inextensible belt to be strapped around the user's wait. The buoyant band extends circumferentially behind the wearer from just forward of each hip where it terminates in an enlarged lobe portion. Thus the stomach and general body area in front of the wearer are free from interference and the buoyancy of the two lobe portions and interconnecting back band tend to raise the wearer to a vertical position as opposed to a naturally occurring forward face to the water position.

4 Claims, 1 Drawing Sheet

SWIMMING AID DEVICE

This application is a continuation of Ser. No. 07/822,206, filed Jan. 16, 1992, now abandoned.

BACKGROUND OF THE INVENTION

This invention relates to a swimming aid device which consists of a particularly shaped buoyant attachment for encircling the waist area of the swimmer or exerciser and supporting him in a certain manner. More particularly, the device relates to a detachable buoyant exercising aid which is particularly adapted for use in exercise or stationery swimming where the device is so shaped to support the wearer in a generally vertical position.

Swimming or exercise in the water is considered to be most beneficial when the person exercising is easily maintaining his head out of the water but is generally immersed in the water so that the water provides additional resistance to movement of the arms and legs. This is particularly true in remedial exercise as when the swimmer has a mild disability such as an impaired cardiac function.

This vertical position is not always an attainable goal since swimming occurs at the interface between two fluids, a relatively dense fluid (water) and a relatively light fluid (air). All swimming buoyant devices or life saving devices are of course attachments of the wearer's body which assists in keeping at least a portion of the body (the face) above the interface of the two fluids. Examples of the most rudimentary belt or band type devices are shown in U.S. Pat. No. 3,049,735 issued Aug. 21, 1962; U.S. Pat. No. 3,077,618 issued Feb. 19, 1963; U.S. Pat. No. 3,094,725 issued Jun. 25, 1963 or U.S. Pat. No. 3,137,015 issued Jun. 16, 1964. These devices are symbolic of a large body of prior art in which a generally elongate buoyant strap is positioned around the waist of the user and held in place by an inextensible strap or tie. The function of the buoyant strap is merely to increase the total buoyancy of the wearer, thus assisting the wearer to maintain his position above the surface, particularly after engaging in strenuous activity such as water skiing, etc.

Another example of a swimming device is shown in U.S. Pat. No. 3,138,809 issued Jun. 30, 1964 in which a swimming aid is provided with adjustable buoyancy for the convenience of the wearer or for adoption with many sizes of the wearer. While this device is considered to have certain advantages, the device still positions itself essentially around the waist of the wearer and does not particularly assist the wearer in maintaining a particular position.

Other examples of coat-type flotation devices or vests are shown, for example, in U.S. Pat. No. 4,689,030 issued Aug. 25, 1987 or U.S. Pat. No. 4,547,165 issued Oct. 15, 1985. Each of these patents is symbolic of a large number of prior art devices in which a vest or coat-type of swimming aid is provided with no real effort to tilt the body in one direction or to adjust or free the shoulders or arms of the wearer for exercise.

Finally, other devices which expose the shoulder, etc. for exercise but which provide buoyancy due to the material are shown, for example, in U.S. Pat. No. 1,446,099 issued Feb. 20, 1923 or U.S. Pat. No. 2,940,453 issued Jun. 16, 1960 in which the waterproof material is attempted to be disguised as a conventional bathing suit. While such devices may have their place in certain fields, there are not considered to be material prior art as against the flotation device of this invention.

U.S. Pat. No. 5,000,710 issued Mar. 19, 1991 for a deep water exercise belt does address some of the problems which are encountered when trying to support a swimmer or exercise a patient in the proper position in water. In this patent, a generally buoyant geometrically shaped band of material is strapped around the wearer's waist, with extensions of the material above and below the waist positioned at the back of the wearer. It is pointed out in that patent specification that the use of security lines, such as are shown in U.S. Pat. No. 4,551,108 have inherent disadvantages in which the user is never given the complete sense of independence and is also restricted to a particular location within the tank which can be reached or controlled by the security lines. Without any security lines, it is asserted that the geometry of the exercise belt shown in the aforementioned U.S. Pat. No. 5,000,710 will naturally cause the user to come at rest in a forward leaning position, naturally leaning forward about 15 to 20 degrees beyond the vertical so that the face and arms are dangling downward into the water for natural treading water or swimming movement.

OBJECTS OF THE INVENTION

It is an object of this invention to provide a swimming flotation device of the type heretofore described which, because of its geometric disposition when properly placed upon the wearer, will keep the wearer in a more erect or vertical position than any of the prior art devices heretofore described and, has the additional advantage of being tetherless or lineless, of being lightweight and being generally inexpensive to manufacture.

Another object of this invention is to provide a swimming device which can be easily adjusted to many sizes of wearer, does not interfere with the arm or chest action of the swimmer, and can be fabricated from normal buoyant waterproof materials.

Another advantage and object is, because the device is small and inexpensive, it can be fabricated in a number of colors and such devices of different colors may be used by coaches or trainers to distinguish different competitive groups or groups of different swimming skills, etc., much like color coded uniforms.

Other advantages of the invention will be apparent from the following detailed description of a preferred embodiment thereof, with reference being made to the accompanying drawings, in which:

DETAILED DESCRIPTION OF THE INVENTION

Figure 1:
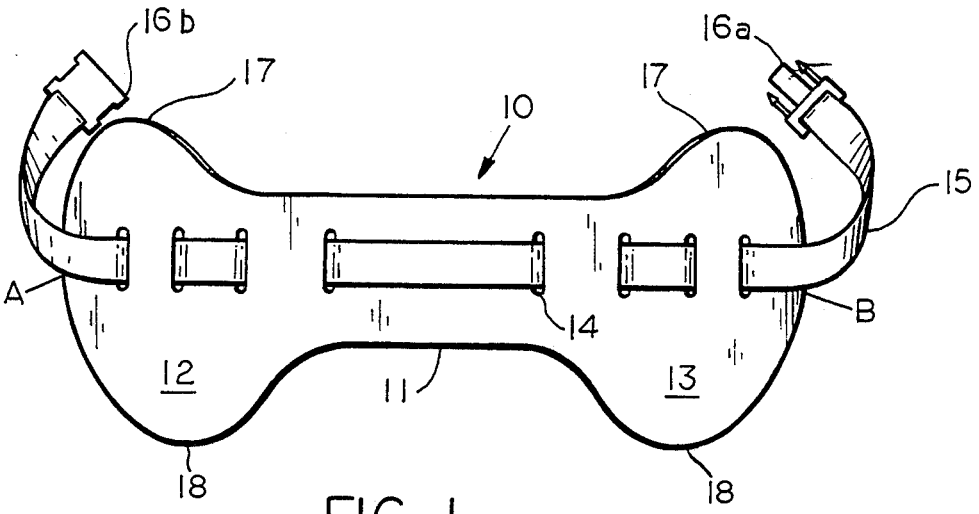
FIG. 1 is a general view in elevation of the swimming device of this invention, showing it unattached in a free or open position.
Figure 2:
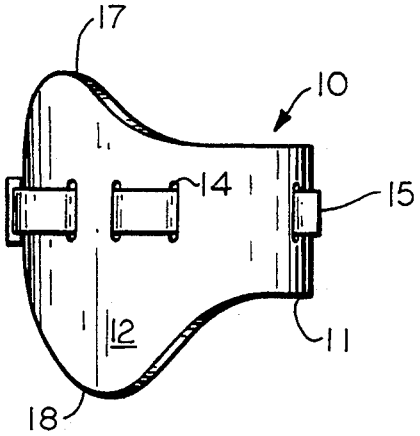
FIG. 2 is a folded or closed view of the device as it might be stored when not being used.
Figure 3:
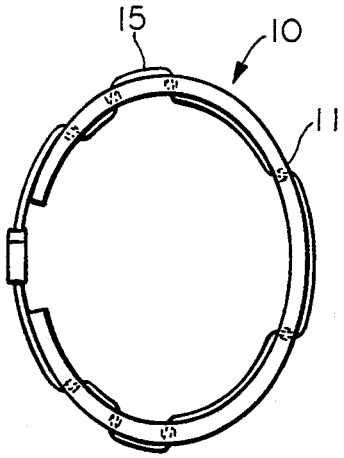
FIG. 3 is a top view looking downwardly upon the device when in its closed and buckled position.

Referring first to FIG. 1, the water exercise device 10 consists of a waist encircling band 11 having a uniform vertical height or thickness in the middle of the band 11 with a lobe or projection 12 and 13 at each end of the band 11. As seen in FIG. 1, the device when fully open has a general "dog bone" configuration with enlarged lobes or vertical projections 12 and 13 on either end of the band 10. Extended through a number of notches or slits 14 in the device 10 is a strap 15 which typically will include a plastic or metallic snap 16*a* and its female counterpart 16*b*. The strap will normally be made of canvas belting material, the snap 16*a* or 16*b* being releasable by the user and a length adjustment device (not shown) which is typical with swimming, skiing or other athletic equipment may be provided to make the length of the strap 15 adjustable to various size users.

There is no particular number of slots 14 or loop configurations necessary for the strap 15 to be interwoven with the device 10. A satisfactory arrangement is shown in FIG. 1 but others are possible. It is important, of course, that the ends of the strap 15 extend around the ends or lobes 12 and 13 of the device as shown at points A and B in FIG. 1 so that they hold the edges of the device firmly against the swimmer's stomach or midsection when attached as shown in FIG. 4.

Figure 4:
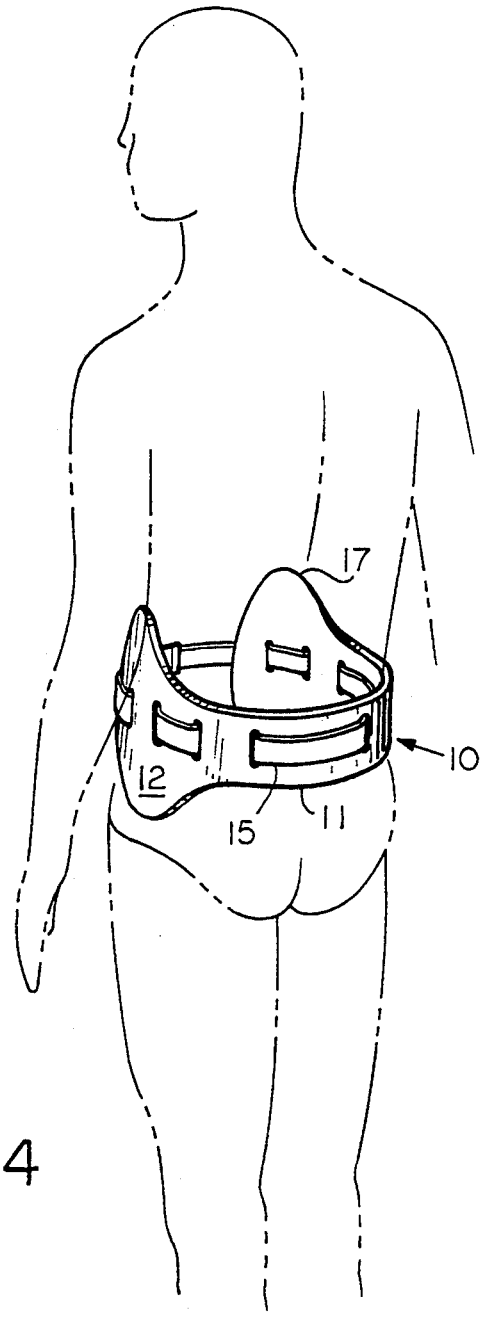
FIG. 4 is a view in perspective of the device shown attached to a wearer shown in phantom, with its upper and lower lobes or projections in proper position upon the wearer.

As seen in FIG. 4, each of the distal lobes or vertical projections extend upwardly from the band 11 in the area designated by reference numeral 17 and downwardly below the strap 10 in the area designated by reference numeral 18. As best seen in FIG. 1, the downward projections 18 are slightly closer together when measured in a horizontal direction than are the upward projections 17. This means that the downward projections 17 will be more in contact with the lateral area of the wearer's buttocks whereas the upper projection 17 will extend more around the hip toward the stomach of the wearer.

When the wearer immerses himself in water and reaches equilibrium, the strongest buoyant force from the device occurs in the area of the largest part of the device which would be the combination of the lobes or projections 12 and 13. These are positioned on the hip and forward of the hip which tend to rotate the body of the wearer slightly backwards so that the body will remain substantially vertical in the water and the wearer will not be slumped forward with his face over the water. This is believed to be a distinction over the prior art, particularly over that position described in U.S. Pat. No. 5,000,710, in that the natural position of the wearer without any exercise or movement is approximately vertical in the device of this invention.

The device of this invention may be constructed of any material normally used for swimming aids. The material must be flexible, have a smooth surface and not irritate the skin of the user. Chemically cross-linked polyethylene, closed cell ethyl vinyl acetate or flexible polyurethane with a polyethylene cover or polypropylene has been found to be satisfactory while even some of the older conventional materials such as shredded cork bound in canvas, etc. may be satisfactory. The choice of material for fabrication does not constitute a material aspect of the invention of this application. In addition, it is believed that a smooth grease and dirt-resistant surface is preferred for the exercise device of this invention.

It will be understood from the foregoing description that it will be apparent that various changes may be made in the form, construction and arrangement of this invention without departing from the spirit and scope of the invention and the claims which are appended hereto.

I claim:

1. A water exercise device to be worn by a wearer to increase buoyancy thereof comprising, in combination, an elongate waist-encircling band of flexible buoyant material and an inextensible flexible belt coextensive therewith for strapping about the wearer's waist, said buoyant band having a minimum uniform vertical extent surrounding the waist of the wearer, said buoyant band terminating at each end just forward of the hip on each side of the wearer, said each end having an enlarged lobe portion, said lobe portion comprising an upper part extending above said uniform minimum vertical extent and a lower part extending below said uniform minimum vertical extent, said upper part being located nearer said each end of said elongate band such that, when worn, said upper part is positioned further forward of said lower part.

2. The water exercise belt of claim 1 wherein said elongate waist band is a strap of closed cell foam selected from the group consisting of polyethylene, polyurethane, or polypropylene.

3. The water exercise belt of claim 2 wherein said elongate waist band is a strap of generally uniform cross-section and said lobe portions at each end thereof extending substantially above and below the minimum uniform vertical extent of said band to provide an upper part adjacent to the hips of the wearer and a lower part adjacent to the sides of the wearer.

4. A water exercise device to be worn by a wearer desirous of acquiring a different buoyancy while exercising comprising, in combination, a waist-encircling band of homogeneous elastomeric material which is attached to an inextensible belt secured about the waist of the wearer, said band having a minimum uniform vertical extent, said minimum uniform vertical extent wrapping circumferentially around the wearer's back, said band further having enlarged lobe portions which protrude a substantial distance above and below said minimum uniform vertical extent of said band, said lobe portions comprising an upper part for abutting the hip region of the wearer and a lower part for abutting the side region of the wearer, whereby said upper part is worn further forward than said lower part, whereby the buoyant force exerted upon the wearer is non-uniform due to the geometric irregularities of said lobe portions.

* * * * *